US006533034B1

(12) United States Patent
Barger

(10) Patent No.: US 6,533,034 B1
(45) Date of Patent: Mar. 18, 2003

(54) CENTRALIZED STOP COLLAR FOR FLOATING CENTRALIZER

(75) Inventor: Troy Barger, Houston, TX (US)

(73) Assignee: Flotek Industries, Inc., Houston, TX (US)

( * ) Notice: Subject to any disclaimer, the term of this patent is extended or adjusted under 35 U.S.C. 154(b) by 0 days.

(21) Appl. No.: 09/570,868

(22) Filed: May 15, 2000

(51) Int. Cl.[7] ..... E21B 17/10
(52) U.S. Cl. ..... 166/241.7; 166/241.3
(58) Field of Search ..... 166/241.1, 241.2, 166/241.4, 241.6, 241.7

(56) References Cited

U.S. PATENT DOCUMENTS

| | | | | |
|---|---|---|---|---|
| 2,312,600 A | | 3/1943 | Steps | |
| 2,622,684 A | * | 12/1952 | Kluck | 166/241.6 |
| 2,628,682 A | | 2/1953 | Wright | |
| 2,652,118 A | * | 9/1953 | Hartmena et al. | 166/241.6 X |
| 2,717,650 A | | 9/1955 | Hall, Sr. | |
| 2,718,266 A | * | 9/1955 | Berry et al. | 166/241.6 |
| 2,962,313 A | * | 11/1960 | Conrad | 166/241.7 X |
| 3,044,554 A | * | 7/1962 | Kluck | 166/241.6 |
| 3,124,196 A | * | 3/1964 | Solum | 166/241.6 |
| 3,369,607 A | * | 2/1968 | Turbyfill | 166/241.7 X |
| 3,575,239 A | | 4/1971 | Solum | |
| 3,762,472 A | | 10/1973 | Alexander, Jr. | |
| 4,658,896 A | | 4/1987 | Milan | |
| 4,766,663 A | | 8/1988 | Milan | |
| 4,794,986 A | | 1/1989 | Langer | |
| 4,875,524 A | | 10/1989 | Bradley et al. | |
| 4,938,299 A | | 7/1990 | Jelsma | |
| 5,113,938 A | | 5/1992 | Clayton | |
| 5,261,488 A | | 11/1993 | Gullet et al. | |
| 5,358,039 A | | 10/1994 | Fordham | |
| 5,499,681 A | | 3/1996 | White et al. | |
| 5,881,810 A | | 3/1999 | Reinholdt et al. | |
| 5,937,948 A | | 8/1999 | Robbins, III | |

FOREIGN PATENT DOCUMENTS

| | | | | |
|---|---|---|---|---|
| SU | 832034 | * | 5/1981 | 166/241.7 |

* cited by examiner

*Primary Examiner*—Frank Tsay
(74) *Attorney, Agent, or Firm*—Conley Rose, P.C.

(57) ABSTRACT

A centralizer for engagement with a pipe exterior surface to be positioned downhole in a wellbore. The centralizer includes a collar which can be fastened with set screws or other connector to the pipe exterior surface. A body is engaged with said collar for containing axial movement of the body within a selected portion of the pipe exterior surface while facilitating rotational movement of the body relative to the pipe exterior surface. The engagement between the collar and the body permits rigid attachment of the collar to the pipe while permitting the centralizer to free-float relative to the pipe.

19 Claims, 2 Drawing Sheets

CENTRALIZED STOP COLLAR FOR FLOATING CENTRALIZER

BACKGROUND OF THE INVENTION

The present invention relates to the field of wellbore cementing and completions. More particularly, the present invention relates to an improved apparatus for placing pipe downhole in a wellbore and for directing cement placement around the pipe exterior.

The production of oil and gas requires well tools, casing pipe, production tubing and other structures to be positioned downhole in a wellbore. Production tubing or pipe provides a conduit for transporting hydrocarbon fluids from the subsurface formation to the well surface. To prevent the migration of the hydrocarbon fluids around the pipe exterior, and to prevent the dilution of the hydrocarbon fluids with water produced from other strata, cement is placed in the annulus between the casing exterior and the wellbore wall.

To facilitate the formation of a uniform cement bond, pipe centralizers are installed on the pipe exterior to center the pipe in the wellbore so that cement is evenly distributed around the pipe. Centralizers are particularly useful in deviated and horizontal wells where the pipe rests against one side of the wellbore. In addition to the installation and bearing functions provided, centralizers restrict fluid channeling and cement voids by evenly distributing cement in the annulus between the pipe and the wellbore surface. The centralizers retain the tubular in the wellbore center so that cement can be pumped evenly in the annulus formed by the tubular and the wellbore surfaces.

Centralizers are connected to the exterior surface of casing pipe and other tubulars before the pipe is run downhole in a wellbore. Centralizers are attached to the tubular with set screws or with stop collars connected at either end of the centralizers. In other applications, a centralizer is placed between a stop collar and the enlarged pipe circumference of a pipe joint.

Various fixed and floating centralizers have been developed. Different centralizer types generally include flexible bow spring and solid body styles. As described in U.S. Pat. No. 3,762,472 to Alexander (1973), centered placement also inhibits tubular sticking as thousands of feet of tubular is run downhole in a wellbore.

Flexible spring centralizers have elastic ribs extending outwardly to contact the wellbore surface. Representative examples of flexible spring centralizers were illustrated in U.S. Pat. No. 4,938,299 to Jelsma (1990), which disclosed a centralizer having flexible blades for facilitating movement of the centralizer through deviated wellbore sections, and U.S. Pat. No. 5,261,488 to Gullet (1993), which disclosed a bow spring centralizer having the springs initially collapsed with a retainer band. U.S. Pat. No. 4,875,524 to Bradley et al. (1989) disclosed a semi-rigid floating spring type centralizer useful in horizontal or highly deviated wellbores.

Various centralizer type devices have been used to accomplish other functions downhole in a wellbore. U.S. Pat. No. 5,992,525 to Williamson et al. (1999) disclosed a spring member attached to a centralizer for preventing the centralizer from inadvertantly entering a lateral wellbore in a multilateral wellbore. U.S. Pat. No. 5,113,938 to Clayton (1992) disclosed an inflatable packer having an articulated whipstock attached below the packer for permitting sidetracks below the packer. U.S. Pat. No. 5,881,810 to Reinhold et al. (1999) disclosed a centralizer having two annular bands connected with a plurality of angled members. U.S. Pat. No. 5,358,039 to Fordham (1994) disclosed a centralizer having hinged spring blades for contacting the wellbore surface. U.S. Pat. No. 3,575,239 to Solum (1971) disclosed a bow spring centralizer having various springs for progressively contacting a restricted opening. In another use, U.S. Pat. No. 4,794,986 to Langer (1989) disclosed a reticulated centralizing device having muliple collars and bow springs. Additionally, U.S. Pat. No. 5,499,681 to White et al. (1996) disclosed a liner hanger for centering a liner within a wellbore.

Bow spring centralizers continuously exert forces against the wellbore wall, and these forces complicate pipe running operations. Such forces enhance the possibility of a pipe becoming stuck in the wellbore and must be overcome before the pipe can be rotated or reciprocated within the wellbore. Complications presented by flexible bow spring centralizers are particularly acute in deviated and horizontal wellbores.

Some of the spring centralizer disadvantages are eliminated by solid body centralizers. One example of a solid body centralizer was disclosed in U.S. Pat. No. 5,937,948 to Robbins (1999), wherein a centralizer was formed by extruding the centralizer body and extending blades. Various designs for solid body centralizers incorporate straight or angled blades having exterior surfaces for contacting the wellbore.

Regardless of whether a centralizer is bow spring or solid body design, different completion practices control whether a centralizer should be rigidly fixed to the pipe or should be free-floating relative to the pipe. During drilling of a wellbore, rotation of the drill bit creates a spiral microgroove track in the wellbore wall. If a centralizer is rigidly attached to the pipe with set screws, adhesives, or other devices, movement of the pipe and centralizers against the wellbore wall generates torque adversely affecting the pipe. In geologic formations comprising shales or clays or unconsolidated sands, swelling and other factors create irregular wellbores having reduced diameters or ledges capable of preventing movement of the pipe. Wellbore discontinuities are also created at the junctures in multilateral wellbores. Additionally, fixed centralizers can destroy the mud filter cake distributed against the wellbore wall during drilling operations. Damage to such filter cake can lose wellbore circulation and can cause differential pipe sticking within the wellbore.

Because fixed centralizers can restrict pipe movement within the wellbore, free-floating bow spring or solid body centralizers can be installed between stop collars or between a single stop collar and a pipe joint. Stop collars are attached to the pipe exterior surface with multiple set screws turned through apertures in the stop collar frame. Stop collars permit the centralizer to rotate about the pipe and to move axially along the pipe longitudinal axis between the stop collars or pipe joints. In the absence of enlarged diameter pipe joints, two stop collars are required to restrict axial movement of a centralizer. Each stop collar prevents centralizer movement in one direction only and comprises an additional discontinuity in the pipe surface. Although stop collars and free-floating centralizers provide benefits in many applications, such systems increase the overall drilling costs because additional labor and parts can be required to install multiple stop collars on both sides of centralizers.

New wellbore drilling and completion technologies require changes in conventional centralizer practices. Complex wellbore completions systems in different zones and multi-branch wellbores encourages the deployment of multiple tool systems within a single wellbore section. Long horizontal wellbore branches require numerous centralizers distributed over the wellbore length, and conventional centralizers and associated stop collars are not practical in certain horizontal wellbore applications. Accordingly, a need exists for an improved apparatus for centralizing pipe within a wellbore and for distributing cement around the pipe.

SUMMARY OF THE INVENTION

The present invention provides a centralizer for engagement with a pipe exterior surface to be positioned downhole in a wellbore. The centralizer comprises a collar, at least one connector for attaching the collar to the pipe exterior surface, and a body engaged with the collar for containing axial movement of the body within a selected portion of the pipe exterior surface while facilitating rotational movement of the body relative to the pipe exterior surface. The body is further configured to selectively position the pipe relative to the wellbore.

In various embodiments of the invention, the connector can comprise a plurality of set screws, the body can comprise a first ring and a second ring connected by at least two ribs, and the ribs can be straight or angled relative to the longitudinal axis of the pipe.

A plurality of set screws can cooperate with a collar to retain the collar in fixed engagement with the pipe. The body can comprise a cage body forming a space for permitting installation of said collar within said space to limit axial movement of said body within a selected portion of said pipe exterior surface while facilitating rotational movement of said body relative to the pipe exterior surface. A lock can prevent axial or rotational movement of the body relative to the collar.

DESCRIPTION OF THE PREFERRED EMBODIMENTS

The present invention describes an improved apparatus for positioning a pipe or other structure downhole in a wellbore and for evenly distributing cement pumped within the wellbore. As used herein, the terms "pipe" and "pipe exterior surface" are defined to refer to well tools, casing, tubing, production liners, multilateral tubing connections, and other downhole structures or tools whether cylindrical, rectangular, irregular, slotted or otherwise shaped or configured.

Figure 1:
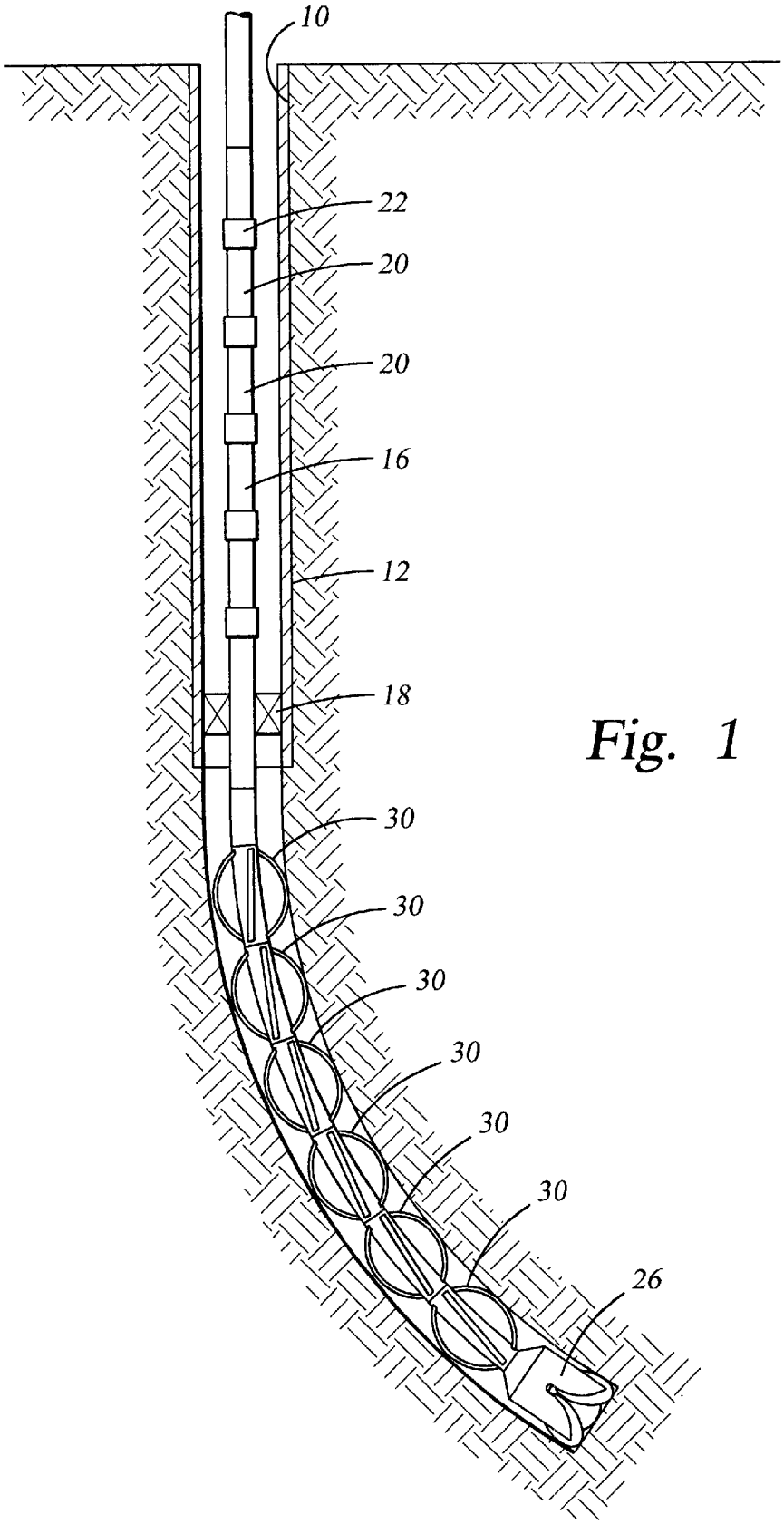
FIG. 1 illustrates a pipe and associated centralizers located within a wellbore.

Referring to FIG. 1, wellbore 10 is drilled into the subsurface geologic formations, and conductor casing 12 is positioned in wellbore 10. Production casing, tubing or pipe 16 is positioned in wellbore 10 and extends from the wellbore surface to the hydrocarbon producing zone. If desired, production packer 18 can be placed in the annulus between pipe 16 and wellbore 10 to prevent migration of fluids through such annulus.

Pipe 16 can be constructed with pipe sections 20 typically having a length of forty feet. Alternatively, pipe 16 can be formed with seamless coiled tubing or other tubular structure. As shown in FIG. 1, adjacent pipe sections 20 are joined with a pipe joint 22 having an exterior diameter greater than the outside diameter of pipe section 20. This larger dimension in pipe joint 22 is typically formed by the box end of pipe section 20, although stop collars or other limitation devices can be used as described below. In other operations such as in coiled tubing operations, the exterior of pipe 16 can be uniform. Pipe shoe 26 can anchor the lower end of pipe 16 in wellbore 10.

Figure 2:
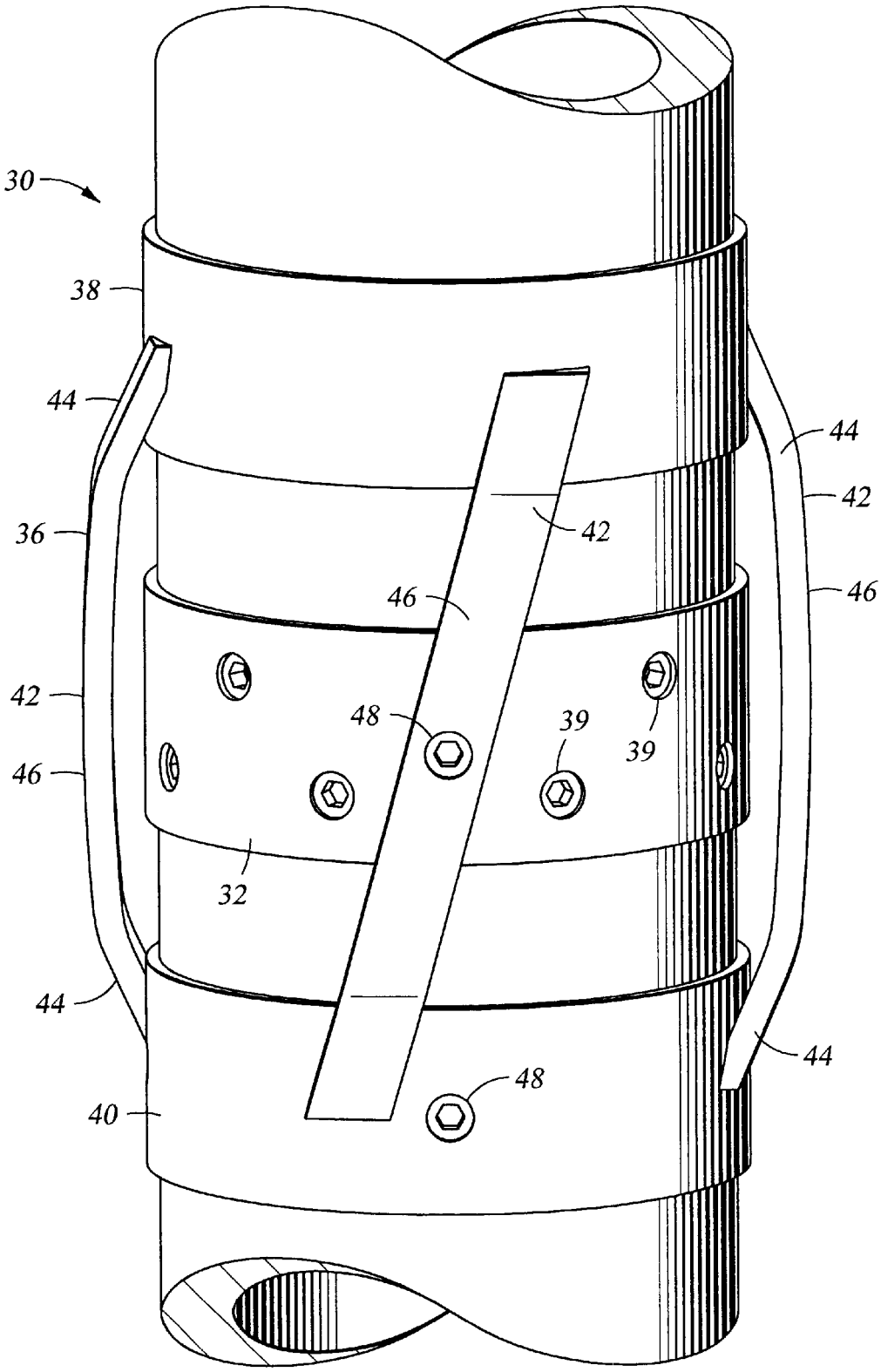
FIG. 2 illustrates a centralizer formed by a collar and body having first and second rings connected with at least one rib.

Centralizers 30 are engaged with pipe 16 at selected intervals to position pipe 16 within wellbore 10 and to evenly distribute cement between pipe 16 exterior surface and the interior wall of wellbore 10. As shown in FIG. 2, centralizer 30 generally includes collar 32, a connector such as set screws 34, and body 36. As shown in FIG. 2, one embodiment of body 36 comprises first ring 38, second ring 40, and one or more ribs 42 connected therebetween. Each rib 42 has beveled surfaces 44 for facilitating movement of centralizer 30 within wellbore 10, and further has exterior surface 46 for contacting the wall of wellbore 10.

Collar 32 is illustrated as a cylindrical ring placed around pipe 16. The configuration of collar 32 can be formed in different shapes to accomplish the function of permitting locked engagement with pipe 16. Set screws 34 are inserted through apertures in collar 32 and can be tightened with conventional methods to lock collar 32 relative to pipe 16. Set screws 34 can be oriented in different patterns and arrangements to accomplish different design objectives and holding strengths. In a preferred embodiment of the invention, set screws 34 comprise full bore screws which provide maximum holding strength with shorter length than standard set screws. The shorter length is beneficial to the operation of the invention because the shorter full bore screws are less likely to interfere with ribs 42. Although set screws 34 are illustrated, other forms of connectors such as locking rings or adhesives can be used to perform such function. Collar 32 also provides the functional benefit of resisting collapse of ribs 42, thereby providing greater overall lateral strength to centralizer 30.

Body 36 can be formed in many different shapes to cooperate with collar 32 to accomplish the desired functions. Body 36 is engaged with collar 32 to contain axial movement of the body 36 within a selected portion of pipe 16 exterior surface while selectively facilitating rotational movement of body 36 relative to pipe 16. In one embodiment of the invention first ring 38 and second ring 40 can have interior dimensions larger than the exterior surface of pipe 16, and such interior dimensions are smaller than said collar 32. In this manner, the configuration of body 36 forms an interior opening or space for containment of collar 32, and such containment restricts axial movement of body 36 relative to the fixed relationship between collar 32 and pipe 16. In other embodiments of the invention, first ring 38 and second ring 40 can have the same dimensions as collar 32, and ribs 42 can be undercut to provide clear tolerance between ribs 42 and collar 32.

Ribs 42 can be angled relative to the longitudinal axis of pipe 16 as shown in FIG. 2 or can be substantially straight. The orientation, shape, and number of ribs 42 depends on the desired configuration of body 36. Ribs 42 are preferably rigid to resist generation of additional spring forces radially outwardly against wellbore 10. Ribs 42 can be formed with a material different than first ring 28 and second ring 40 or can integrally formed with the same cast, poured, extruded, or forged material. Similarly, collar 32 can be formed with a different material than that forming body 36.

Collar 32 can be formed to facilitate rotation of body 36 relative to pipe 16. In different forms, collar 32 can comprise a bearing for rotation of body 36. Alternatively, a lock such as set screws or shear pins 48 can be optionally provided to fix body 36 relative to collar 32 or to pipe 16. Such feature would convert centralizer 30 from a free-floating design to a fixed design with minimal cost or effort. The strength of shear pins 48 can be selected to control the axial or the rotational forces necessary to convert centralizer 30 from a rigid centralizer to a free-floating centralizer.

The invention uniquely provides the connection strength typically associated with fixed centralizers with the operational benefits provided by free-floating centralizers. Because only one collar 32 is required to limit axial movement of body 36 in both axial directions, significant equipment and labor costs are avoided. Set screws 34 similarly retain collar 32 in both axial directions, thereby increasing the overall system efficiency. The amount of axial travel can be constrained by the interior space within body 32 to virtually no travel, or to relatively large degree of axial travel. Large axial travel may be desired to permit "jarring" of pipe 16 and centralizers 30 if pipe 16 should become stuck within wellbore 10.

The invention avoids the strength problems associated with hinged centralizers by permitting slip on installation over one end of a pipe section as pipe 16 is assembled. The elimination of hinged centralizer connections prevents centralizer failures caused by a broken hinge.

Although different embodiments of the invention are illustrated as having a body and a wiper element, it will be appreciated by one skilled in the art that the body and wiper can be cast, molded or formed into a single, integral unit or can be fabricated from a combination of components. The body can be constructed from plastic, elastomers, rubber, metal, composite fibers. Alternatively, the body can be formed from a combination of different materials while making the body and incorporated wiper in a single component. Although collar 32 is illustrated as movable between a space centered within body 36, it is possible to configure body 36 so that collar 32 is located toward one end of body 36. In addition to the open cage design of body 36 shown in FIG. 2, the exterior of body 36 could be more or less enclosed to form the space for constraining relative travel between body 36 and collar 32.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A centralizer for engagement with a pipe exterior surface to be positioned downhole in a wellbore, comprising:

a collar;

at least one connector for attaching said collar to the pipe exterior surface;

a body comprising at least two non-spring ribs and an opening for containing said collar therein;

wherein said collar contains axial movement of said body within a selected portion of the pipe exterior surface;

wherein said at least two non-spring ribs facilitate rotational movement of said body relative to the pipe exterior surface; and wherein said body is further configured to selectively position the pipe relative to the wellbore.

2. A centralizer as recited in claim 1, wherein said connector comprises a plurality of set screws positioned within apertures through said collar.

3. A centralizer as recited in claim 1, wherein said collar is configured as a cylinder.

4. A centralizer as recited in claim 1, wherein said opening is substantially located at one end of said body.

5. A centralizer as recited in claim 1, wherein said body further comprises a first ring and a second ring connected by said at least two ribs to form said opening for containing said collar.

6. A centralizer as recited in claim 5, wherein said ribs are oriented substantially parallel to the pipe.

7. A centralizer as recited in claim 5, wherein said ribs are oriented at an angle relative to a longitudinal axis of the pipe.

8. A centralizer as recited in claim 5, wherein said first and second rings have interior dimensions larger than the pipe exterior surface and smaller than said collar for retaining said collar between said first and second rings.

9. A centralizer as recited in claim 1, wherein said collar is formed with a material differing from the material forming said body.

10. A centralizer for engagement with a pipe exterior surface to be positioned downhole in a wellbore, comprising:

a collar;

at least one connector for attaching said collar to the pipe exterior surface; and a body having a first ring and a second ring connected by at least one non-spring rib to form a space, wherein said body is positionable so that said space contains said collar to limit axial movement of said body within a selected portion of said pipe exterior surface while facilitating rotational movement of said body relative to the pipe exterior surface.

11. A centralizer as recited in claim 10, wherein said connector comprises a plurality of set screws positioned within apertures through said collar.

12. A centralizer as recited in claim 10, wherein said rib has an exterior surface for contacting the wellbore.

13. A centralizer as recited in claim 10, wherein said rib is oriented substantially parallel to the pipe.

14. A centralizer as recited in claim 10, wherein said rib is oriented at an angle relative to a longitudinal axis of the pipe.

15. A centralizer as recited in claim 10, wherein said first and second rings have interior dimensions larger than the pipe exterior surface and smaller than said collar for retaining said collar between said first and second rings.

16. A centralizer for engagement with a pipe exterior surface to be positioned downhole in a wellbore, comprising:

a collar;

a plurality of set screws for attaching said collar to the pipe exterior surface; and a cage body, further comprising at least one non-spring rib, forming a space for permitting installation of said collar within said space, wherein attachment of said collar to the pipe limits axial movement of said body within a selected portion of said pipe exterior surface while facilitating rotational movement of said body relative to the pipe exterior surface.

17. A centralizer as recited in claim 16, further comprising a lock for attaching said body to said collar to prevent relative movement between said body and said collar.

18. A centralizer as recited in claim 17, wherein said lock prevents rotational movement between said body and said collar.

19. A centralizer as recited in claim 17, wherein said lock prevents axial movement between said body and said collar.

* * * * *